US010969715B2

(12) United States Patent
Yoshida et al.

(10) Patent No.: US 10,969,715 B2
(45) Date of Patent: Apr. 6, 2021

(54) IMAGE FORMING APPARATUS AND METHOD OF OPERATING AN IMAGE FORMING APPARATUS WITH INTERMITTENT PRINTING MODES

(71) Applicant: TOSHIBA TEC KABUSHIKI KAISHA, Tokyo (JP)

(72) Inventors: Masafumi Yoshida, Sunto Shizuoka (JP); Takashi Ogiwara, Numazu Shizuoka (JP); Kazumasa Yasui, Arakawa Tokyo (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/773,511

(22) Filed: Jan. 27, 2020

(65) Prior Publication Data

US 2020/0278626 A1 Sep. 3, 2020

(30) Foreign Application Priority Data

Mar. 1, 2019 (JP) ..... JP2019-037548

(51) Int. Cl.
*G03G 15/20* (2006.01)

(52) U.S. Cl.
CPC ..... *G03G 15/205* (2013.01)

(58) Field of Classification Search
CPC ..... G03G 15/205; G03G 15/50
See application file for complete search history.

(56) References Cited

U.S. PATENT DOCUMENTS

| | | | | |
|---|---|---|---|---|
| 7,177,559 | B2 | 2/2007 | Inoue et al. | |
| 8,374,517 | B2 | 2/2013 | Nagatsuka | |
| 2007/0212083 | A1* | 9/2007 | Ishikuro | G03G 15/5008 399/44 |
| 2014/0064756 | A1 | 3/2014 | Sugiyama et al. | |
| 2014/0233972 | A1* | 8/2014 | Sugiyama | G03G 15/55 399/44 |

FOREIGN PATENT DOCUMENTS

| | | | |
|---|---|---|---|
| EP | 2498140 | A2 | 9/2012 |
| JP | H1020718 | A | 1/1998 |
| JP | 2011209597 | A | 10/2011 |
| JP | 2013044966 | | 3/2013 |

OTHER PUBLICATIONS

Extended European Search Report dated Oct. 23, 2020 in related European Patent Application 20157570.1, 11 pages.

* cited by examiner

*Primary Examiner* — Sandra Brase
(74) *Attorney, Agent, or Firm* — Kim & Stewart LLP

(57) ABSTRACT

An image forming apparatus includes a control unit that changes a ratio between an execution time for executing printing and a stop time for stopping the printing according to any one of a stop control number that is the number of times that an operation of the printing is stopped, a stop control time that is the time during which the operation of the printing is stopped, a printing execution time that is the time during which the printing is executed, and a printing execution control number that is the number of times that the printing is executed, in an intermittent mode that operates by switching between executing the printing and stopping the printing.

18 Claims, 7 Drawing Sheets

IMAGE FORMING APPARATUS AND METHOD OF OPERATING AN IMAGE FORMING APPARATUS WITH INTERMITTENT PRINTING MODES

CROSS-REFERENCE TO RELATED APPLICATION

This application is based upon and claims the benefit of priority from Japanese Patent Application No. 2019-037548, filed Mar. 1, 2019, the entire contents of which are incorporated herein by reference.

FIELD

Embodiments described herein relate generally to an image forming apparatus and a method of operating an image forming apparatus.

BACKGROUND

When the toners used in an image forming apparatus are excessively affected by heat, the toners stick to each other and are fixed. When a printing operation is performed in this state, the fixed toners may be caught in a doctor blade of a developing device and appear as a blank image or a white spot image. In order to solve such problems, two methods have been taken in the related art.

The first method is a method of reducing the temperature of the toner inside a developing device and the doctor blade by applying cooling air to the developing device case and the doctor blade to improve the convection heat radiation efficiency. However, in this method, it is necessary to provide a cooling structure in the image forming apparatus, and space is limited due to recent miniaturization of image forming apparatuses.

The second method is switching to intermittent printing when the temperature in the image forming apparatus becomes high during printing. In the intermittent printing in which the printing operation and the stoppage of the printing operation are repeatedly executed, the temperature rise can be suppressed by stopping the printing.

However, the temperature may continue to rise even after the transition to the intermittent mode depending on the transition timing to the intermittent mode and the stoppage time during the intermittent mode. In such a case, an image defect may occur.

DETAILED DESCRIPTION

Embodiments provide an image forming apparatus capable of suppressing temperature rise during printing.

The image forming apparatus according to the embodiment includes a control unit. The control unit changes a ratio between an execution time for executing printing and a stop time for stopping the printing according to any one of a stop control number that is the number of times that an operation of the printing is stopped, a stop control time that is the time during which the operation of the printing is stopped, a printing execution time that is the time during which the printing is executed, and a printing execution control number that is the number of times that the printing is executed, in an intermittent mode that operates by switching between executing the printing and stopping the printing.

Hereinafter, an image forming apparatus of an embodiment will be described with reference to drawings.

Figure 1:
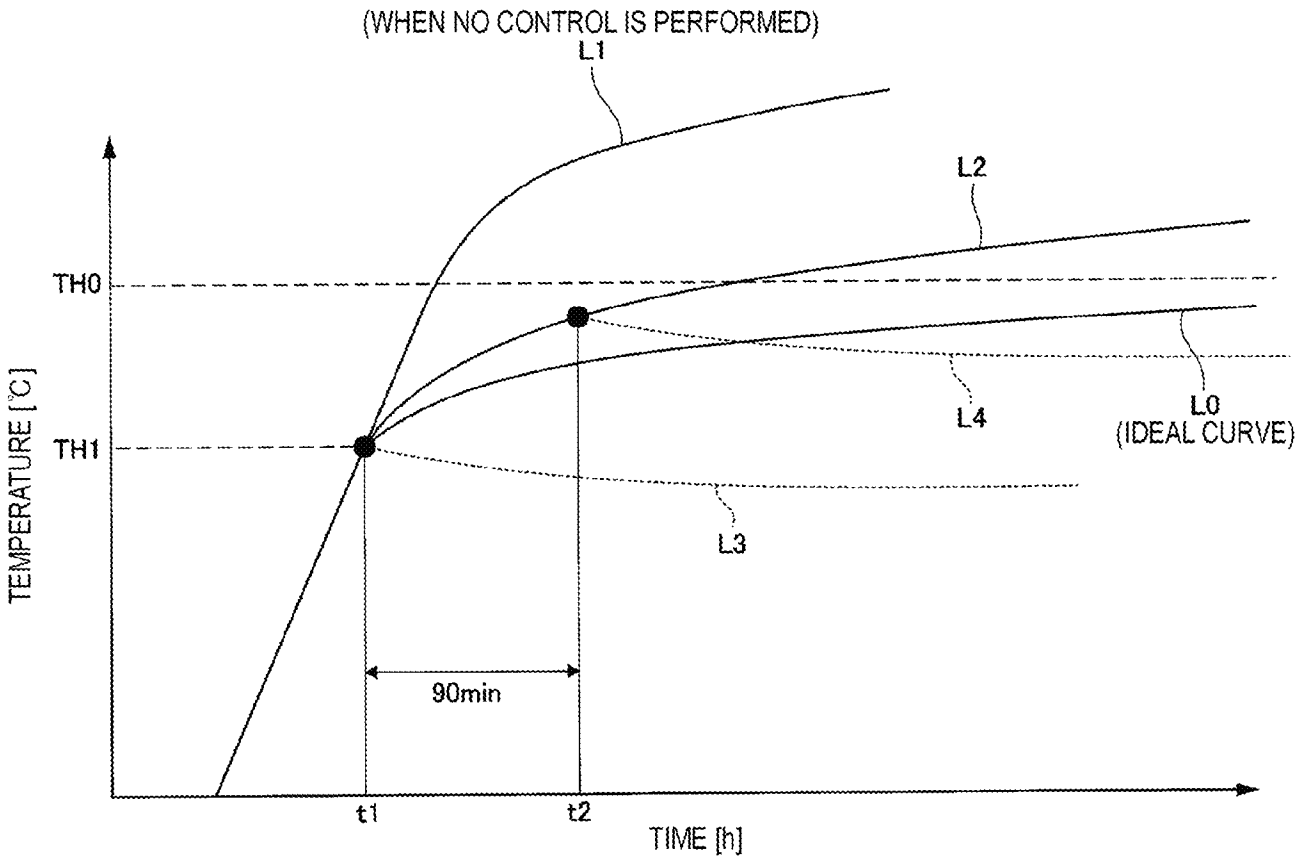
FIG. 1 is a view illustrating characteristics of an image forming apparatus according to an embodiment.

FIG. 1 is a view illustrating an overview of the image forming apparatus according to an embodiment. The image forming apparatus according to the embodiment is an image forming apparatus premised on large-capacity and long-time printing. In the graph illustrated in FIG. 1, the horizontal axis represents time (h), and the vertical axis represents the temperature (° C.) in the image forming apparatus. The temperature inside the image forming apparatus is, for example, the temperature of a drum thermistor. In FIG. 1, TH0 represents the upper limit temperature. In general, it is desirable that the image forming apparatus is operated so as not to exceed the upper limit temperature TH0.

When the image forming apparatus continues to perform printing and the internal temperature reaches TH1 (time t1), if the control continues as it is, the temperature inside the machine rises like the curve indicated by L1. As a result, the temperature inside the image forming apparatus exceeds the upper limit temperature TH0. Therefore, the image forming apparatus performs printing in an intermittent operation so as not to exceed the upper limit temperature TH0. Ideally, it is best to set the printing and stop times to operate along a temperature curve like L0. However, even if the control is performed with a setting aiming at a temperature curve such as L0 from the results obtained through experiments or the like, the upper limit temperature TH0 may be exceeded as illustrated by the temperature curve of L2 due to machine error or environment.

On the other hand, when the temperature inside the machine reaches TH1 (time t1), if the control is performed to operate along a temperature curve like L3 to be on the safer side, the performance will drop too much. In other words, when the temperature inside the image forming apparatus reaches TH1 (time t1), if the stop time is increased as illustrated by a temperature curve like L3, the performance is too low.

In consideration of the above points, the image forming apparatus according to an embodiment can perform large-capacity and long-time printing while suppressing temperature rise during printing by performing two-stage control. Specifically, the image forming apparatus performs a first-stage intermittent control aiming at the temperature curve of L0 at the time t1. Thereafter, if the temperature does not decrease, the image forming apparatus switches to a second-stage intermittent control aiming at the temperature curve of L4 at the time t2. Details will be described below.

Figure 2:
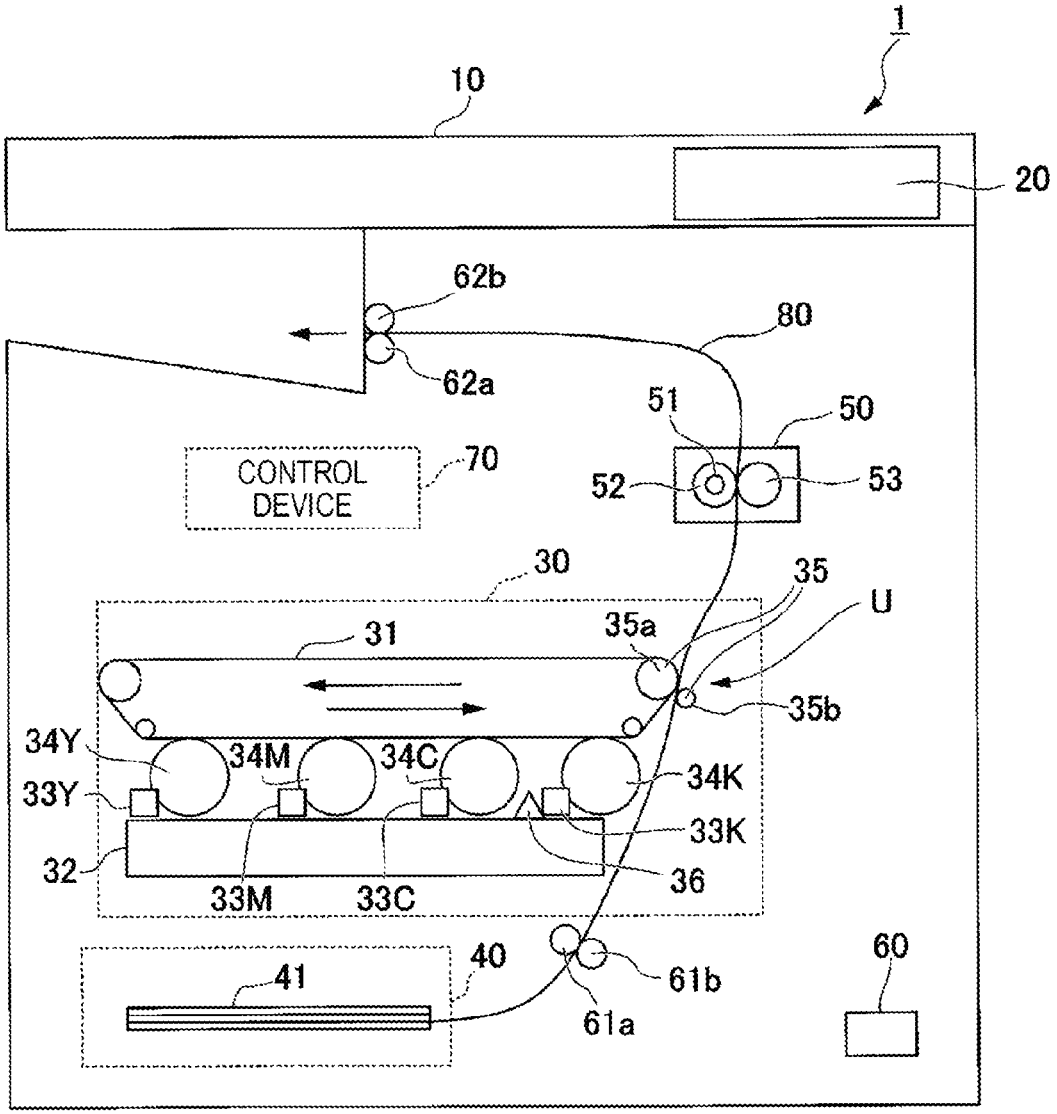
FIG. 2 is an external view illustrating an overall configuration of an image forming apparatus according to an embodiment.

FIG. 2 is an external view illustrating an overall configuration of an image forming apparatus according to the embodiment. The image forming apparatus 1 according to the embodiment is a multi-function peripheral (MFP). The image forming apparatus 1 executes image forming processing and image fixing processing. The image forming processing is processing for forming an image on a sheet. The image fixing processing is processing for fixing an image formed on the sheet. The sheet is, for example, an original document, paper on which characters, images, and the like are described. The sheet may be anything that may be read by the image forming apparatus 1. The image forming apparatus 1 reads an image appearing on the sheet, generates digital data, and generates an image file.

The image forming apparatus 1 includes an image reading unit 10, a control panel 20, an image forming unit 30, a sheet storage unit 40, a fixing device 50, a first temperature sensor 60, transport rollers 61*a* and 61*b*, paper discharge rollers 62*a* and 62*b*, and a control device 70.

The image reading unit 10 reads an image to be read as light contrast. For example, the image reading unit 10 reads an image printed on a reading target sheet set on a document reading table. The image reading unit 10 records the read image data. The recorded image data may be transmitted to another information processing device via a network. The recorded image data may be formed on a sheet by the image forming unit 30.

The control panel 20 includes a display unit and an operation unit. The display unit is a display device such as a liquid crystal display and an organic electro luminescence (EL) display. The display unit displays various information related to the image forming apparatus 1 in accordance with the control of the control device 70. The operation unit includes a plurality of buttons. The operation unit receives a user operation. The operation unit outputs a signal corresponding to the operation performed by the user to the control device 70. The display unit and the operation unit may be configured as an integrated touch panel.

The image forming unit 30 executes image forming processing. In the image forming processing, the image forming unit 30 forms an image on the sheet based on the image data generated by the image reading unit 10 or the image data received via a communication path.

The image forming unit 30 includes a transfer belt 31, an exposure unit 32, a plurality of developing devices 33 (developing devices 33Y, 33M, 33C, and 33K), a plurality of photoconductive drums 34 (photoconductive drums 34Y, 34M, 34C, and 34K), a transfer unit 35, and a second temperature sensor 36.

The transfer belt 31 is an intermediate transfer member. The transfer belt 31 rotates in the direction indicated by the arrow (counterclockwise) by the rotation of a roller.

The exposure unit 32 is provided at a position facing the photoconductive drums 34Y, 34M, 34C, and 34K of the developing devices 33Y, 33M, 33C, and 33K. The exposure unit 32 irradiates the surface (photoconductive layer) of each of the photoconductive drums 34Y, 34M, 34C, and 34K with laser light. The exposure unit 32 is controlled to emit light based on the image data under the control of the control device 70. The exposure unit 32 emits laser light based on the image data. As a result, the negative charge on the surface (photoconductive layer) of each photoconductive drum 34Y, 34M, 34C, and 34K disappears. As a result, an electrostatic pattern is formed on the surface (photoconductive layer) of the photoconductive drums 34Y, 34M, 34C, and 34K at the position irradiated with the laser light. In other words, electrostatic latent images are formed on the surfaces (photoreceptor layers) of the photoconductive drums 34Y, 34M, 34C, and 34K by irradiation of the laser light from the exposure unit 32. The exposure unit 32 may use light emitting diode (LED) light instead of laser light.

The developing devices 33Y, 33M, 33C, and 33K supply toners to the photoconductive drums 34Y, 34M, 34C, and 34K. For example, the developing device 33Y develops the electrostatic latent image on the surface (photoconductive layer) of the photoconductive drum 34Y with yellow (Y). The developing device 33M develops the electrostatic latent image on the surface (photoconductive layer) of the photoconductive drum 34M with magenta (M). The developing device 33C develops the electrostatic latent image on the surface (photoconductive layer) of the photoconductive drum 34C with cyan (C). The developing device 33K develops the electrostatic latent image on the surface (photoconductive layer) of the photoconductive drum 34K with black (K) toner.

The developing devices 33Y, 33M, 33C, and 33K form toner images as visible images on the photoconductive drums 34Y, 34M, 34C, and 34K. The toner images formed on the photoconductive drums 34Y, 34M, 34C, and 34K are transferred (primary transfer) onto the transfer belt 31.

The transfer unit 35 includes a support roller 35*a* and a secondary transfer roller 35*b*. The transfer unit 35 transfers the toner image on the transfer belt 31 to the sheet at a secondary transfer position U. The secondary transfer position U is a position where the support roller 35*a* and the secondary transfer roller 35*b* face each other with the transfer belt 31 therebetween. The transfer unit 35 gives a transfer bias controlled by a transfer current to the transfer belt 31. The transfer unit 35 transfers the toner image on the transfer belt 31 to the sheet by the transfer bias. The control device 70 controls the transfer current used for the secondary transfer processing.

The second temperature sensor 36 measures the temperature inside the image forming apparatus 1. More specifically, the second temperature sensor 36 measures the temperature in the vicinity of the photoconductive drum 34 as the temperature inside the image forming apparatus 1. The second temperature sensor 36 is installed in the vicinity of the photoconductive drums 34. The second temperature sensor 36 is, for example, a thermistor. The second temperature sensor 36 outputs the measured temperature information in the vicinity of the photoconductive drums 34 to the control device 70 as second temperature information.

The sheet storage unit 40 includes one or a plurality of paper feed cassettes. The sheet feed cassette stores sheets 41 of a predetermined size and a predetermined type. The paper feed cassette includes a pickup roller. The pickup roller picks up the sheets 41 one by one from the paper feed cassette. The roller supplies the picked-up sheet 41 to the conveyance unit 80.

The fixing device 50 executes image fixing processing. Specifically, the fixing device 50 fixes the toner image on the sheet 41 by heating and pressing the sheet 41. The fixing device 50 includes a heating source 51, a heat roller 52, and a pressure roller 53. The heating source 51 is a heater lamp having a halogen lamp or an induction heating (IH) type heater. The heating source 51 is turned on or off depending on whether or not the control device 70 is energized. The heat roller 52 is warmed by the heat generated when the heating source 51 is energized. The heat roller 52 applies heat to the sheet 41. The pressure roller 53 is installed facing the heat roller 52. The pressure roller 53 presses the sheet 41 against the heat roller 52. The fixing device 50 is provided with a temperature sensor (not illustrated). The temperature sensor measures the temperature of the heat roller 52. The temperature sensor transmits the measured temperature of the heat roller 52 to the control device 70.

The first temperature sensor 60 measures the temperature inside the image forming apparatus 1. More specifically, the first temperature sensor 60 measures the temperature at a location different from the location where the second temperature sensor 36 is installed as the temperature inside the image forming apparatus 1. For example, the first temperature sensor 60 measures the temperature inside the image forming apparatus 1 other than the image forming unit 30. The first temperature sensor 60 is installed at a place other than the image forming unit 30. The first temperature sensor 60 is, for example, a temperature and humidity sensor. The first temperature sensor 60 outputs information on the measured temperature inside the image forming apparatus 1 to the control device 70 as first temperature information.

The transport rollers 61*a* and 61*b* supply the sheet 41 fed from the paper feed cassette to the image forming unit 30. The transport rollers 61*a* and 61*b* are installed at opposing positions.

The paper discharge rollers 62*a* and 62*b* discharge the sheet 41 on which the image is formed by the fixing device 50 to the discharge unit. The paper discharge rollers 62*a* and 62*b* are installed at opposing positions.

The control device 70 controls each functional unit of the image forming apparatus 1.

The conveyance unit 80 conveys the sheet 41. The conveyance unit 80 includes a conveyance path and a plurality of rollers (not illustrated). The conveyance path is a path along which the sheet 41 is conveyed. The rollers convey the sheet 41 by rotating according to the control of the control device 70.

Figure 3:
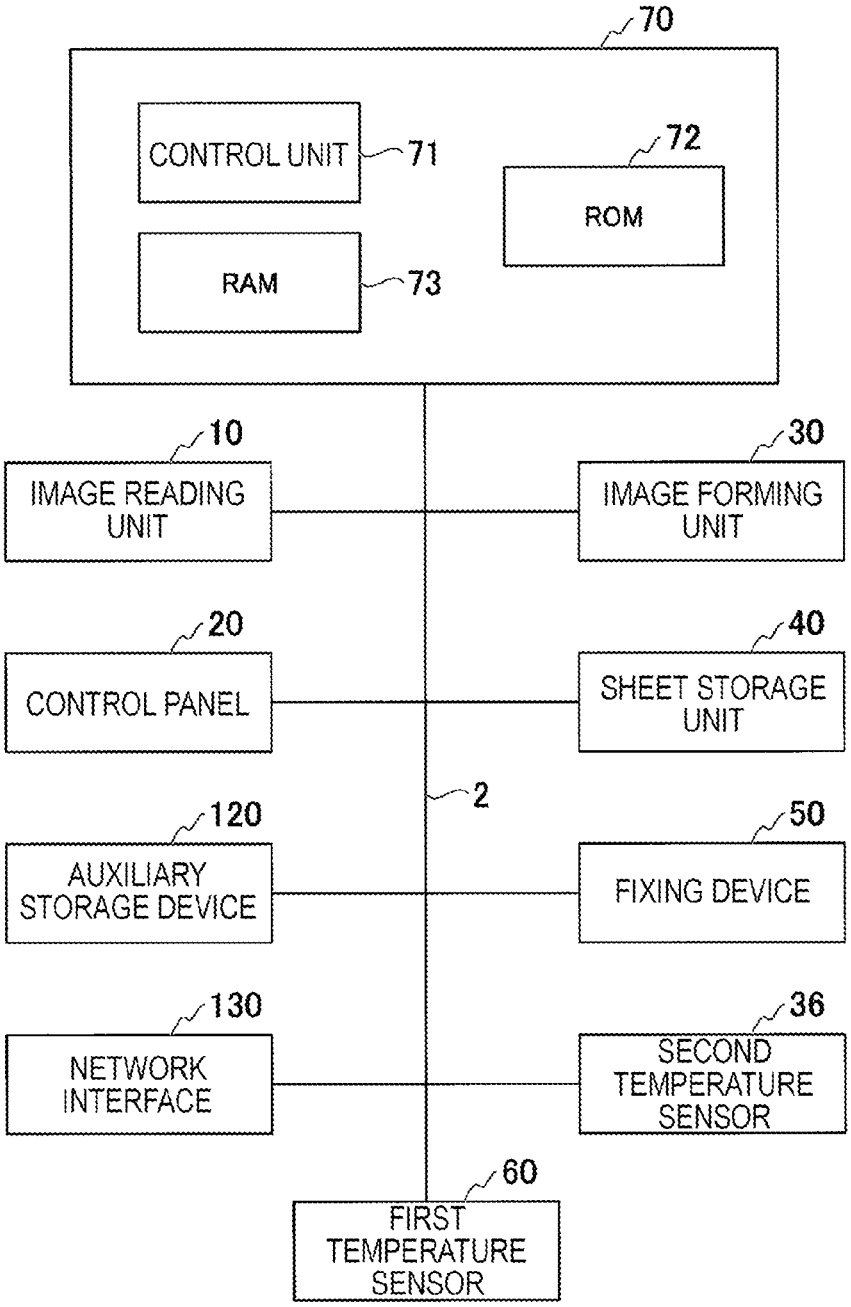
FIG. 3 is a block view illustrating a hardware configuration of the image forming apparatus according to the embodiment.

FIG. 3 is a block view illustrating a hardware configuration of the image forming apparatus 1. FIG. 3 illustrates only a characteristic hardware configuration of the image forming apparatus 1 according to the embodiment.

The image forming apparatus 1 includes the image reading unit 10, the control panel 20, the image forming unit 30, the second temperature sensor 36, the sheet storage unit 40, the fixing device 50, the first temperature sensor 60, the control device 70, an auxiliary storage device 120, and a network interface 130.

Since the image reading unit 10, the control panel 20, the image forming unit 30, the second temperature sensor 36, the sheet storage unit 40, the fixing device 50, and the first temperature sensor 60 are the same as those described above, the descriptions thereof are omitted. Hereinafter, the control device 70, the auxiliary storage device 120, and the network interface 130 will be described. Each functional unit is connected via a system bus 2 so that data communication is possible.

The control device 70 includes a control unit 71, a read only memory (ROM) 72, and a random access memory (RAM) 73. The control unit 71 is, for example, a processor such as a central processing unit (CPU) or a graphics processing unit (GPU). The control unit 71 controls the operation of each functional unit of the image forming apparatus 1. The control unit 71 executes various processing by loading and executing the program stored in the ROM 72 in the RAM 73. For example, the control unit 71 operates in either the normal mode or the intermittent mode to execute the image forming processing and the image fixing processing. The normal mode is a mode in which printing by image forming processing and image fixing processing is continuously performed according to a printing instruction. More specifically, unlike the intermittent mode, the normal mode is a mode in which a requested job is executed without being stopped. The term "without being stopped" here excludes an abnormality such as a failure or toner running out.

The intermittent mode is a mode in which printing by image forming processing and image fixing processing, and printing stop are repeated according to a printing instruction. The intermittent mode includes a first intermittent mode and a second intermittent mode. The difference between the first intermittent mode and the second intermittent mode is the length of the stoppage time. Whether the image forming apparatus 1 operates in the first intermittent mode or the second intermittent mode is determined according to the number of times of stop control, hereinafter referred to as the stop control number. The stop control number is the number of times that the printing operation is stopped in the intermittent mode, for example. The intermittent mode at the time of switching from the normal mode to the intermittent mode may be either the first intermittent mode or the second intermittent mode. The stoppage time in the first intermittent mode is longer than the stoppage time in the second intermittent mode. That is, when the image forming apparatus 1 operates in the second intermittent mode, the stoppage time is longer than that in the first intermittent mode. Thereby, it is possible to cool the image forming unit 30 rather than operating in the first intermittent mode.

The ROM 72 stores a program for operating the control unit 71. The RAM 73 temporarily stores data used by each functional unit included in the image forming apparatus 1. The RAM 73 may store digital data generated by the image reading unit 10. The RAM 73 may temporarily store jobs and job logs.

The auxiliary storage device 120 is, for example, a hard disk or a solid state drive (SSD) and stores various data. The various data are, for example, digital data, jobs, job logs, and the like.

The network interface 130 transmits and receives data to and from other devices. Here, the other device is an information processing device such as a personal computer. The network interface 130 operates as an input interface and receives data or instructions transmitted from other devices. An instruction transmitted from another device includes a print execution instruction. The network interface 130 operates as an output interface and transmits data to another device.

Next, specific processing of the control unit 71 will be described.

The control unit 71 acquires first temperature information from the first temperature sensor 60 and acquires second temperature information from the second temperature sensor 36. The control unit 71 determines whether or not a predetermined temperature condition is satisfied by using the acquired first temperature information and second temperature information. Further, the control unit 71 determines whether or not the predetermined control condition is satisfied based on the stop control number in the intermittent mode.

The control unit 71 controls the conveyance of the sheet 41 by controlling various rollers. Specifically, the control unit 71 operates the various rollers to convey the sheet 41 during the execution of the image forming processing and the image fixing processing. The control unit 71 stops the conveyance of the sheet 41 by stopping the operation of various rollers while the execution of the image forming processing and the image fixing processing is stopped.

The control unit 71 controls the operation mode of the image forming apparatus. The control unit 71 sets the operation mode of the image forming apparatus to either the normal mode or the intermittent mode according to the determination result.

The control unit 71 controls printing by image forming processing and image fixing processing. Specifically, the control unit 71 operates the image forming unit 30 and the fixing device 50 to execute printing during the execution of the image forming processing and the image fixing processing. The control unit 71 stops the printing of the sheet 41 by stopping the operation of the image forming unit 30 and the fixing device 50 while the execution of the image forming processing and the image fixing processing is stopped. The control unit 71 may cause the fixing device 50 to idle, or may cause the fixing device 50 to idle after being stopped.

Figure 4:
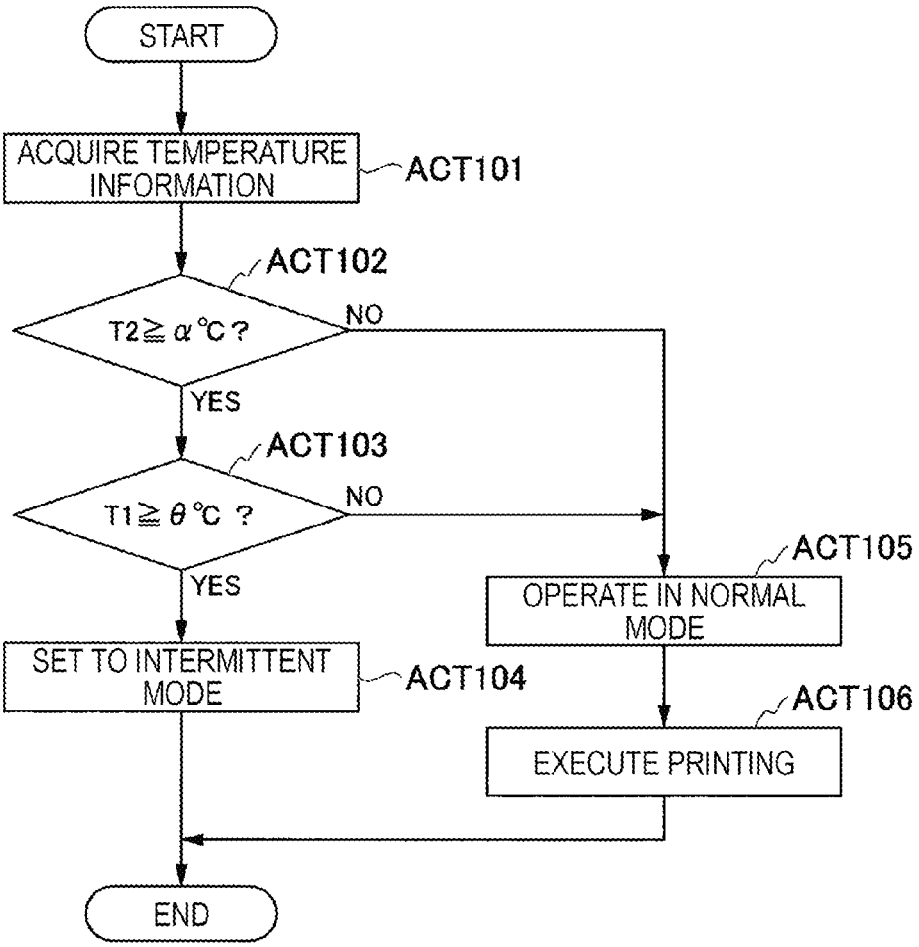
FIG. 4 is a flowchart illustrating a flow of processing performed by the image forming apparatus in a normal mode according to the embodiment.

FIG. 4 is a flowchart illustrating a flow of processing performed by the image forming apparatus 1 in the normal mode according to the embodiment.

The first temperature sensor 60 measures the temperature of the location where the first temperature sensor is installed at a first timing. The first temperature sensor 60 outputs the measured temperature information to the control device 70 as first temperature information. The first timing may be a timing when a preset time is reached, or may be a timing at which a predetermined period elapses.

The second temperature sensor 36 measures the temperature of the location where the second temperature sensor is installed at a second timing. The second temperature sensor 36 outputs the measured temperature information to the control device 70 as second temperature information. The second timing may be a timing when a preset time is reached, or may be a timing when a predetermined period elapses.

The control unit 71 acquires first temperature information from the first temperature sensor 60 and acquires second temperature information from the second temperature sensor 36 (ACT 101). The control unit 71 compares a second temperature T2 (the temperature in the vicinity of the photoconductive drum 34) indicated by the acquired second temperature information with a second comparison temperature α° C. The second comparison temperature α° C. is a temperature set in advance for comparison with the second temperature T2. For example, the second comparison temperature α° C. is 43° C.

The control unit 71 determines whether or not the second temperature T2 is equal to or higher than the second comparison temperature α° C. (ACT 102).

When the second temperature T2 is equal to or higher than the second comparison temperature α° C. (ACT 102: YES), the control unit 71 executes the processing of ACT 103. The control unit 71 compares a first temperature T1 (temperature in the image forming apparatus 1 other than the image forming unit 30) indicated by the acquired first temperature information with a first comparison temperature θ° C. The first comparison temperature θ° C. is a temperature set in advance for comparison with the first temperature T1. For example, the first comparison temperature θ° C. is 31° C.

The control unit 71 determines whether or not the first temperature T1 is equal to or higher than the first comparison temperature θ° C. (ACT 103). When the first temperature T1 is equal to or higher than the first comparison temperature θ° C. (ACT 103: YES) and the second temperature T2 is equal to or higher than the second comparison temperature α° C. (ACT 102: YES), the control unit 71 sets the operation mode of the image forming apparatus to the intermittent mode (ACT 104).

In the processing of ACT 102, when the second temperature T2 is lower than the second comparison temperature α° C. (ACT 102: NO), the control unit 71 maintains the operation mode of the image forming apparatus in the normal mode (ACT 105) to execute printing (ACT 106).

In the processing of ACT 103, when the first temperature T1 is lower than the first comparison temperature θ° C. (ACT 103: NO), the control unit 71 maintains the operation mode of the image forming apparatus in the normal mode (ACT 105) to execute printing (ACT 106).

Figure 5:
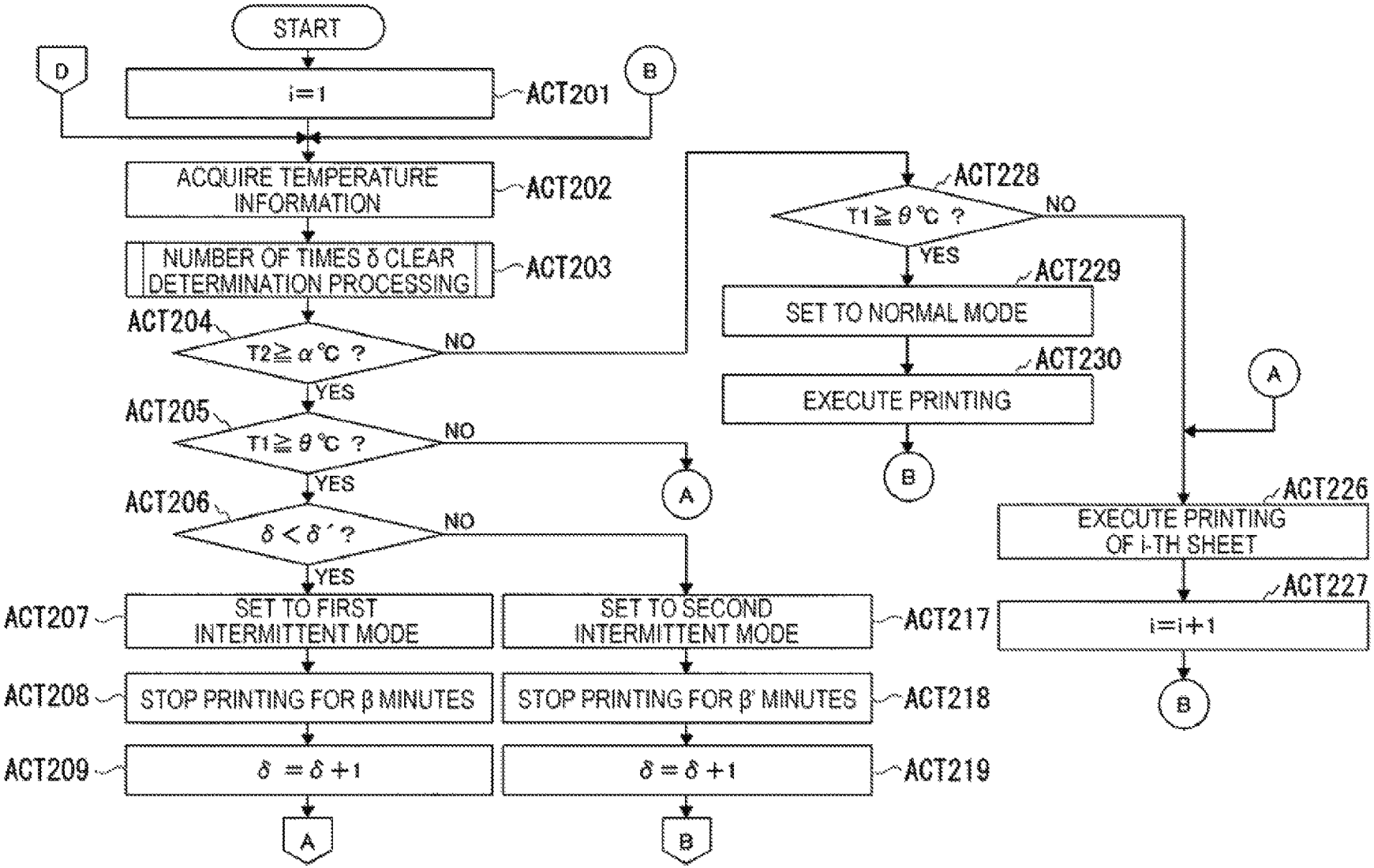
FIGS. 5 and 6 are a flowchart illustrating a flow of processing performed by the image forming apparatus in an intermittent mode according to the embodiment.
Figure 6:
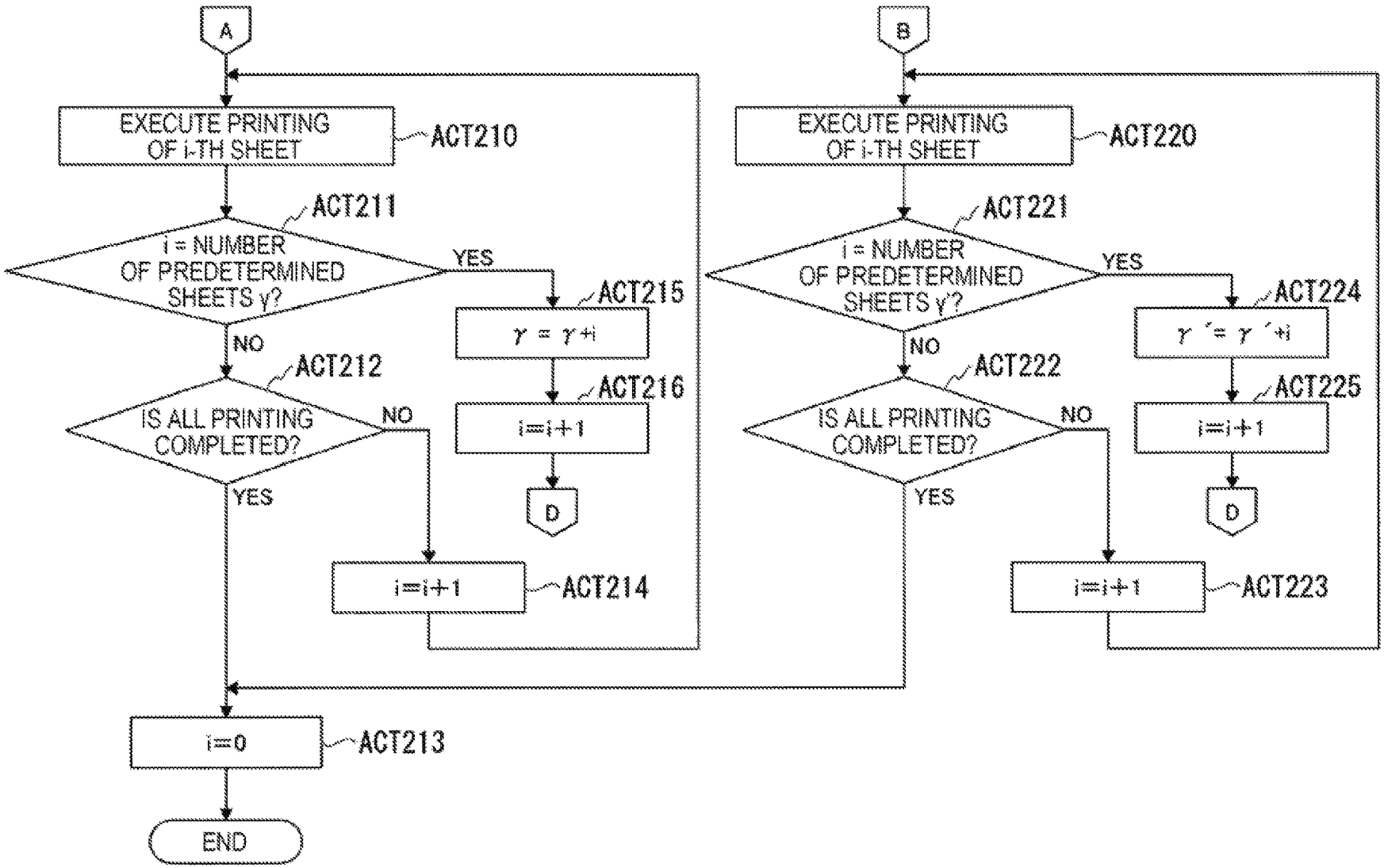

FIGS. 5 and 6 are flowcharts illustrating the flow of processing performed by the image forming apparatus 1 in the intermittent mode according to the embodiment.

The control unit 71 sets the number of printed sheets i=1 (ACT 201). Next, the control unit 71 acquires first temperature information from the first temperature sensor 60 and acquires second temperature information from the second temperature sensor 36 (ACT 202).

The control unit 71 executes the stop control number δ clear determination processing (ACT 203) based on the acquired first temperature information and second temperature information. The stop control number δ clear determination processing is processing for determining whether or not to initialize the value of the stop control number δ. Details of the stop control number δ clear determination processing will be described with reference to FIG. 7. When it is determined that the value of the stop control number δ is initialized by the stop control number δ clear determination processing, the value of the stop control number δ becomes zero.

On the other hand, when it is determined that the value of the stop control number δ is not initialized by the stop control number δ clear determination processing, the value of the stop control number δ becomes a current count value.

The control unit 71 compares the second temperature T2 indicated by the acquired second temperature information with the second comparison temperature α° C. The control unit 71 determines whether or not the second temperature T2 is equal to or higher than the second comparison temperature α° C. (ACT 204). When the second temperature T2 is equal to or higher than the second comparison temperature α° C. (ACT 204: YES), the control unit 71 executes the processing of ACT 205. The control unit 71 compares the first temperature T1 indicated by the acquired first temperature information with the first comparison temperature θ° C. The control unit 71 determines whether or not the first temperature T1 is equal to or higher than the first comparison temperature θ° C. (ACT 205).

When the first temperature T1 is equal to or higher than the first comparison temperature θ° C. (ACT 205: YES), the control unit 71 determines whether or not the stop control number δ is less than a threshold stop control number δ' (ACT 206). The control unit 71 acquires the count value of the stop control number δ. The threshold stop control number δ' is a value serving as a reference value for determining which intermittent mode, the first intermittent mode or the second intermittent mode, the image forming apparatus is operating in and is, for example, 21.

When the stop control number δ is less than the threshold stop control number δ' (ACT 206: YES), the control unit 71 sets the operation mode of the image forming apparatus to the first intermittent mode (ACT 207). Thereafter, the image forming apparatus 1 stops printing for a first stop time β (for example, 1 minute) (ACT 208). Specifically, the control unit 71 stops the various rollers from the time when operating in the first intermittent mode until the first stop time β elapses. The control unit 71 stops the operations of the image forming unit 30 and the fixing device 50 from the time when operating in the first intermittent mode until the first stop time β lapses. For example, the control unit 71 may stop the operations of the image forming unit 30 and the fixing device 50 by stopping the power supply to the image forming unit 30 and the fixing device 50. Thereafter, the control unit 71 adds 1 to the count value of the stop control number δ (ACT 209).

When the first stop time β elapses, the control unit 71 executes printing processing of i-th sheet (ACT 210). Thereafter, the control unit 71 compares the number of printed sheets i with a number of predetermined sheets γ to determine whether or not the number of printed sheets i is equal to the number of predetermined sheets γ (ACT 211). The number of predetermined sheets γ is a reference value for determining whether or not to stop the printing operation again and is, for example, 40 sheets. For example, when the number of predetermined sheets γ is 40, the image forming apparatus 1 stops printing for the first stop time β each time 40 sheets are continuously printed in the first intermittent mode. Here, the continuous printing according to the embodiment does not have to be printing of a plurality of sheets according to one printing instruction. For example, the continuous printing according to the embodiment may be printing of a plurality of sheets according to a plurality of printing instructions. In this case, the image forming apparatus 1 also counts printing by another printing instruction input during execution of printing by one printing instruction as printing by one printing instruction.

When the number of printed sheets i is not the number of predetermined sheets γ (ACT 211: NO), the control unit 71 determines whether or not all printing has been completed (ACT 212). Here, all printing means printing of all requested data. When all the requested data is printed, the control unit 71 determines that all the printing is completed. On the other hand, when printing of all requested data is not completed, the control unit 71 determines that all printing is not completed. When all printing is completed (ACT 212: YES), the control unit 71 initializes the number of printed sheets i (ACT 213).

On the other hand, when all the printing is not completed (ACT 212: NO), the control unit 71 adds 1 to the count value of the number of printed sheets i (ACT 214). Thereafter, the image forming apparatus 1 executes the processing of ACT 210.

In the processing of ACT 211, when the number of printed sheets i is equal to the number of predetermined sheets γ (ACT 211: YES), the image forming apparatus 1 executes the processing of ACT 215. Specifically, the control unit 71 sets a value obtained by adding the count value of the number of printed sheets i at present to the number of predetermined sheets γ as a new number of predetermined sheets γ (ACT 215). For example, when the number of predetermined sheets γ is 30 and the number of printed sheets i is 30, the control unit 71 sets the new number of predetermined sheets γ to 60. Then, the control unit 71 adds 1 to the count value of the number of printed sheets i (ACT 216). Thereafter, the image forming apparatus 1 executes the processing of ACT 202. As described above, when the number of printed sheets i in one time of printing processing reaches the number of predetermined sheets γ, the image forming apparatus 1 acquires the temperature information again and controls the operation mode.

In the processing of ACT 206, when the stop control number δ is equal to or higher than the comparison control threshold δ' (ACT 206: NO), the control unit 71 sets the operation mode of the image forming apparatus to the second intermittent mode (ACT 217). Thereafter, the image forming apparatus 1 stops printing for a second stop time β' (for example, 2.5 minutes) (ACT 218). Specifically, the control unit 71 stops the various rollers from the time when operating in the second intermittent mode until the second stop time β' elapses. The control unit 71 stops the operations of the image forming unit 30 and the fixing device 50 from the time when operating in the second intermittent mode until the second stop time β' elapses. Thereafter, the control unit 71 adds 1 to the count value of the stop control number δ (ACT 219).

When the second stop time β' elapses, the control unit 71 executes printing processing of the i-th sheet (ACT 220). Thereafter, the control unit 71 compares the number of printed sheets i with the number of predetermined sheets γ to determine whether or not the number of printed sheets i is equal to the number of predetermined sheets γ' (ACT 221). The number of predetermined sheets γ' is a reference value for starting the predetermination of the operation mode in the second intermittent mode and is, for example, 40 sheets. When the number of printed sheets i is not the number of predetermined sheets γ' (ACT 221: NO), the control unit 71 determines whether or not all printing is completed (ACT 222). When all printing is completed (ACT 222: YES), the control unit 71 initializes the number of printed sheets i (ACT 213).

On the other hand, when all the printing is not completed (ACT 222: NO), the control unit 71 adds 1 to the count value of the number of printed sheets i (ACT 223). Thereafter, the image forming apparatus 1 executes the processing of ACT 220.

In the processing of ACT 221, when the number of printed sheets i is equal to the number of predetermined sheets γ' (ACT 221: YES), the image forming apparatus 1 executes the processing of ACT 224. Specifically, the control unit 71 sets a value obtained by adding the count value of the number of printed sheets i at present to the number of predetermined sheets γ' as a new number of predetermined sheets γ' (ACT 224). Then, the control unit 71 adds 1 to the count value of the number of printed sheets i (ACT 225). Thereafter, the image forming apparatus 1 executes the processing of ACT 202.

In the processing of ACT 205, when the first temperature T1 is less than the first comparison temperature θ° C. (ACT 205: NO), the control unit 71 executes printing processing of the i-th sheet (ACT 226). After the printing processing of the i-th sheet is completed, the control unit 71 adds 1 to the count value of the number of printed sheets i (ACT 227). Thereafter, the image forming apparatus 1 executes the processing of ACT 202.

In the processing of ACT 204, when the second temperature T2 is less than the second comparison temperature α° C. (ACT 204: NO), the control unit 71 executes the processing of ACT 228. The control unit 71 compares the first temperature T1 indicated by the acquired first temperature information with the first comparison temperature θ° C. The control unit 71 determines whether or not the first temperature T1 is equal to or higher than the first comparison temperature θ° C. (ACT 228).

When the first temperature T1 is less than the first comparison temperature θ° C. (ACT 228: NO) and the second temperature T2 is less than the second comparison temperature α° C. (ACT 204: NO), the control unit 71 executes printing processing of the i-th sheet (ACT 226).

In the processing of ACT 228, when the first temperature T1 is equal to or higher than the first comparison temperature θ° C. (ACT 228: YES) and the second temperature T2 is less than the second comparison temperature α° C. (ACT 204: NO), the control unit 71 sets the operation mode of the image forming apparatus to the normal mode (ACT 229). Thereafter, the control unit 71 performs printing (ACT 230).

Figure 7:
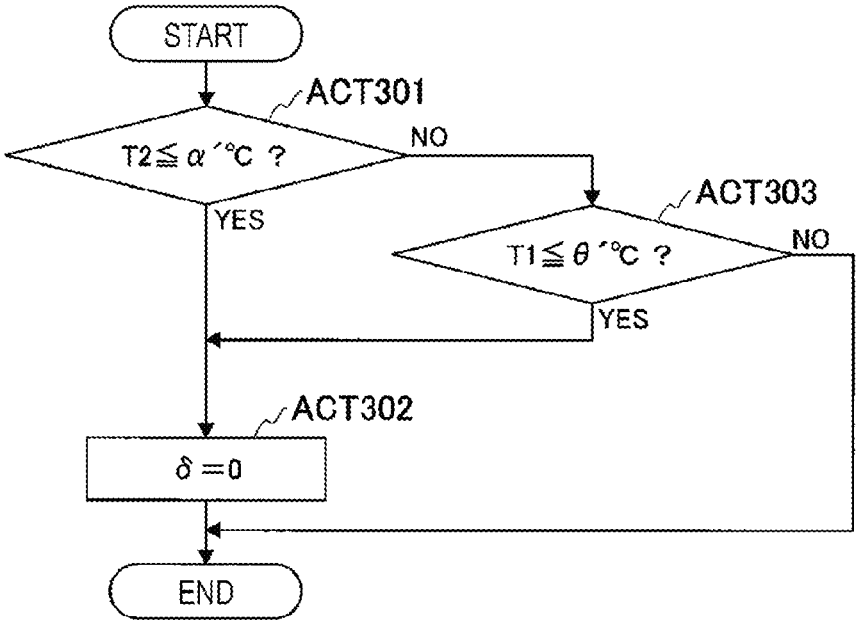
FIG. 7 is a flowchart illustrating a flow of the number of times δ clear determination processing by the image forming apparatus according to the embodiment.

FIG. 7 is a flowchart illustrating a flow of the stop control number δ clear determination processing by the image forming apparatus 1 according to the embodiment.

The control unit 71 compares the second temperature T2 indicated by the acquired second temperature information with a second comparison temperature α'° C. The second comparison temperature α'° C. is a temperature set in advance for comparison with the second temperature T2. For example, the second comparison temperature α'° C. is 42° C. The control unit 71 determines whether or not the second temperature T2 is less than the second comparison temperature α'° C. (ACT 301). When the second temperature T2 is less than the second comparison temperature α'° C. (ACT 301: YES), the control unit 71 initializes the count value of the stop control number δ (ACT 302).

On the other hand, when the second temperature T2 is equal to or higher than the second comparison temperature α'° C. (ACT 301: NO), the control unit 71 executes the processing of ACT 303. The control unit 71 compares the first temperature T1 indicated by the acquired first temperature information with a first comparison temperature θ'° C. The first comparison temperature θ'° C. is a temperature set in advance for comparison with the first temperature T1. For example, the first comparison temperature θ° C. is 30° C.

The control unit 71 determines whether or not the first temperature T1 is less than the first comparison temperature θ'° C. (ACT 303). When the first temperature T1 is less than the first comparison temperature θ'° C. (ACT 303: YES), the control unit 71 initializes the count value of the stop control number δ (ACT 302).

On the other hand, when the first temperature T1 is equal to or higher than the first comparison temperature θ'° C. (ACT 303: NO), the control unit 71 ends the processing of FIG. 7 without initializing the count value of the stop control number δ.

According to the image forming apparatus 1 configured as described above, it is possible to suppress temperature rise during printing. Specifically, the image forming apparatus 1 stops the printing operation for the first stop time β immediately after switching the operation mode of the image forming apparatus 1 from the normal mode to the intermittent mode. Then, when the stop control number δ reaches a predetermined number, the image forming apparatus 1 changes the stop time from the first stop time β to the second stop time β'. The second stop time β' is longer than the first stop time β. In this way, the image forming apparatus 1 changes the ratio between the execution time for executing printing and the stop time for stopping printing in accordance with the stop control number δ of the printing operation in the intermittent mode. Therefore, the stop time is short immediately after switching from the normal mode to the intermittent mode, and the stop time can be extended when the stop control number δ continues to increase. For this reason, it is possible to suppress the temperature rise during printing.

The image forming apparatus 1 operates based on the temperatures (first temperature T1 and second temperature T2) measured by the first temperature sensor 60 and the second temperature sensor 36, respectively, as conditions for transition to the intermittent mode. Specifically, the second temperature sensor 36 is provided in the image forming unit 30 and measures the temperature of the drum thermistor. Depending on the configuration of the image forming apparatus 1, a dump heater may be provided in the image forming unit 30 in order to prevent the photoconductive drum 34 from condensing. In such a case, if the power is turned off for a sleep mode in a low temperature environment, the dump heater is turned on and the photoconductive drum 34 is warmed. Then, the second temperature T2 measured by the second temperature sensor 36 is a temperature including heat generated by the dump heater and is different from an actual temperature. For this reason, when it is determined to transition to the intermittent mode only at the second temperature T2, the transition to the intermittent mode is unnecessarily performed. Therefore, in order to avoid such a problem, the image forming apparatus 1 provides the first temperature sensor 60 at a place that is not easily affected by the temperature generated in the image forming unit 30. The image forming apparatus 1 determines the transition to the intermittent mode by using not only the second temperature T2 but also the first temperature T1 measured by the first temperature sensor 60. The image forming apparatus 1 can determine whether or not there is an influence of the dump heater by referring to the first temperature T1. Even if the second temperature T2 is equal to or higher than the second comparison temperature α° C., if the first temperature T1 is less than the first comparison temperature θ° C., the image forming apparatus 1 determines that there is an influence due to the dump heater. As a result, the image forming apparatus 1 does not transition to the intermittent mode. As described above, the image forming apparatus 1 can suppress unnecessary transition to the intermittent mode.

The image forming apparatus 1 transitions to the intermittent mode based on the temperature measured by the temperature sensors. However, the temperatures measured by the temperature sensors vary depending on the image forming apparatus. Therefore, the image forming apparatus 1 performs the switching from the first stop time β to the second stop time β', which is the second-stage control, based on the stop control number. Thereby, the influence of the variation in the temperature sensors can be suppressed.

The image forming apparatus 1 performs the printing operation continuously until the number of printed sheets i reaches the number of predetermined sheets γ and does not stop the printing operation. Therefore, it is possible to suppress the deterioration of productivity due to frequent stoppage of the printing operation.

Hereinafter, modifications of the image forming apparatus 1 according to the embodiment will be described.

The image forming apparatus 1 may execute the processing of ACT 102 after executing the processing of ACT 103 in the processing of FIG. 4. In this case, the image forming apparatus 1 performs the processing of ACT 105 when NO is determined in the processing of ACT 103 and performs the processing of ACT 102 when YES is determined in the processing of ACT 103. Further, the image forming apparatus 1 performs the processing of ACT 105 when NO is determined in the processing of ACT 102 and performs the processing of ACT 104 when YES is determined in the processing of ACT 102.

The image forming apparatus 1 may execute the processing of ACT 204 after executing the processing of ACT 205 in the processing of FIG. 5. In this case, when NO is determined in the processing of ACT 205, the image forming apparatus 1 determines whether or not the second temperature T2 is equal to or higher than the second comparison temperature α° C. as the processing of ACT 228. The image forming apparatus 1 performs the processing of ACT 204 when YES is determined in the processing of ACT 205. Further, the image forming apparatus 1 performs the processing of ACT 226 when NO is determined in the processing of ACT 204 and performs the processing of ACT 206 when YES is determined in the processing of ACT 204.

The image forming apparatus 1 may execute the processing of ACT 301 after executing the processing of ACT 303 in the processing of FIG. 7. In this case, the image forming apparatus 1 performs the processing of ACT 301 when NO is determined in the processing of ACT 303 and performs the processing of ACT 302 when YES is determined in the processing of ACT 303. Further, the image forming apparatus 1 ends the processing of FIG. 7 when NO is determined in the processing of ACT 301 and performs the processing of ACT 302 when YES is determined in the processing of ACT 301.

In the embodiment, the case where the first comparison temperature θ° C. is higher than the first comparison temperature θ'° C. has been described as an example, but there is no particular limitation. For example, the first comparison temperature θ° C. may be the same as the first comparison temperature θ'° C. or may be lower than the first comparison temperature θ'° C. Similarly, the case where the second comparison temperature α° C. is higher than the second comparison temperature α'° C. has been described as an example, but there is no particular limitation. For example, the second comparison temperature α° C. may be the same as the second comparison temperature α'° C. or may be lower than the second comparison temperature α'° C.

The image forming apparatus 1 may set the second stop time β' shorter than the first stop time β when the stop control number δ is equal to or higher than the threshold stop control number δ'.

The image forming apparatus 1 may be configured to change not only the stop time but also the execution time when the stop control number δ reaches a predetermined number. For example, the control unit 71 of the image forming apparatus 1 may set the stop time longer than before the change or set the execution time shorter than before the change. For example, the control unit 71 of the image forming apparatus 1 may set the execution time longer than before the change or set the stop time longer than the execution time before and after the change.

As described above, when the stop time is set longer than before the change and the execution time is set shorter than before the change, the number of printed sheets decreases as the execution time becomes shorter. The stop time is longer. For this reason, it is possible to suppress the temperature rise during printing. If the execution time is set longer than before the change and the stop time is set longer than the execution time before and after the change, the number of printed sheets increases, but the stop time also becomes longer. For this reason, it is possible to suppress the temperature rise during printing.

The image forming apparatus 1 may be configured to have a plurality of comparison control thresholds and increase the stop time each time the comparison control threshold is exceeded.

In the embodiment, the image forming apparatus 1 has a configuration in which the ratio between the execution time and the stop time is changed according to the stop control number δ, but the embodiment is not limited to thereto. For example, the image forming apparatus 1 may change the ratio between the execution time and the stop time according to stop control time instead of the stop control number δ. The stop control time is the total time for which printing is stopped in one time of printing processing. For example, the image forming apparatus 1 may change the ratio between the execution time and the stop time according to printing execution time instead of the stop control number δ. The printing execution time is the total time for which printing is executed in one time of printing processing. For example, the image forming apparatus 1 may change the ratio between the execution time and the stop time according to the printing execution control number instead of the stop control number δ. The printing execution control number is the total number of times of executing printing in one time of printing processing. For example, when a large amount of printing is performed in one time of printing processing, execution of printing and stop of printing are repeatedly performed. The total number of times of executing printing at this time is the printing execution control number.

The image forming apparatus 1 according to the embodiment described above includes a control unit. The control unit changes the ratio between the execution time and the stop time according to any one of the stop control number, the stop control time, the print execution time, and the printing execution control number. Thereby, the temperature rise at the time of printing can be suppressed.

Some functions of the image forming apparatus 1 in the above-described embodiment may be realized by a computer. In that case, a program for realizing these functions is recorded on a computer-readable recording medium. Then, the functions may be realized by causing a computer system to read and execute a program recorded on a recording medium in which the above-described program is recorded.

The "computer system" referred here includes hardware such as an operating system and peripheral equipment. In addition, "computer-readable recording medium" refers to a portable medium, a storage device, or the like. The portable medium is a flexible disk, magneto-optical disk, ROM, CD-ROM or the like. In addition, the storage device is a hard disk built in the computer system or the like. Furthermore, the "computer-readable recording medium" dynamically holds a program for a short time, such as a communication line for transmitting a program via a communication line. The communication line is a network such as the Internet, a telephone line, or the like. The "computer-readable recording medium" may be a volatile memory inside a computer system serving as a server or a client. The volatile memory holds a program for a certain period of time. The above-described program may be for realizing a part of the above-described functions. Further, the above-described program may be realized by combining the above-described functions with a program already recorded in the computer system.

While certain embodiments have been described, these embodiments have been presented by way of example only, and are not intended to limit the scope of the inventions. Indeed, the novel embodiment described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a control unit configured to change a ratio between an execution time for executing printing and a stop time for stopping the printing according to any one of a stop control number that is the number of times that an operation of the printing is stopped, a stop control time that is the time during which the operation of the printing is stopped, a printing execution time that is the time during which the printing is executed, and a printing execution control number that is the number of times that the printing is executed, in an intermittent mode that operates by switching between executing the printing and stopping the printing.

2. The image forming apparatus according to claim 1, wherein the control unit determines to stop the printing each time a number of printed sheets reaches a predetermined number and stops the printing for the stop control time.

3. The image forming apparatus according to claim 1, wherein in a case where any one of the stop control number, the stop control time, the printing execution time, and the printing execution control number is less than a threshold, the control unit stops the operation of the printing for a first stop time, and in a case where any one of the stop control number, the stop control time, the printing execution time, and the printing execution control number is equal to or higher than the threshold, the control unit stops the operation of the printing for a second stop time different from the first stop time.

4. The image forming apparatus according to claim 3, wherein in a case where any one of the stop control number, the stop control time, the printing execution time, and the printing execution control number is equal to or higher than the threshold, the control unit stops the operation of the printing for the second stop time and changes the execution time.

5. The image forming apparatus according to claim 1, wherein in a case where a temperature in the image forming apparatus falls below a temperature threshold, the control unit initializes a count value of the stop control number, the stop control time, the printing execution time, and the printing execution control number.

6. A method of operating an image forming apparatus, comprising:

determining a first temperature in the image forming apparatus at a location other than an image forming unit of the image forming apparatus;

determining a second temperature in the image forming unit;

operating the image forming unit continuously according to a printing instruction when the first temperature is below a first comparison temperature and the second temperature is below a second comparison temperature;

operating the image forming unit intermittently according to the printing instruction when the first temperature is equal to or higher than the first comparison temperature and the second temperature is equal to or higher than the second comparison temperature, wherein operating the image forming unit intermittently comprises stopping operation of the image forming unit between repeated image forming by the image forming unit according to the printing instruction; and determining a stop control number that corresponds to a number of stops of the image forming unit while operating intermittently.

7. The method according to claim 6, further comprising:

operating the image forming unit in a first intermittent mode having a first stop time when the stop control number is less than a threshold stop control number; and operating the image forming unit in a second intermittent mode having a second stop time when the stop control number is greater than or equal to the threshold stop control number, wherein the second stop time is longer than the first stop time.

8. The method according to claim 6, further comprising:

increasing the stop control number by one after each stop of the image forming unit while operating intermittently;

determining if a number of printings equals a predetermined number of printings;

when the number of printings equals the predetermined number of printings, increasing the predetermined number of printings by the number of printings;

when the number of printings does not equal the predetermined number of printings, determining if all printing according to the printing instruction is completed.

9. The method according to claim 8, further comprising:

when all printing according to the printing instruction is not completed, increasing the number of printings by one; and when all printing according to the printing instruction is completed, initializing the number of printings.

10. The method according to claim 6, further comprising:

initializing the stop control number when the second temperature is less than or equal to a third comparison temperature.

11. The method according to claim 10, further comprising:

initializing the stop control number when the second temperature is greater than the third comparison temperature and the first temperature is less than a fourth comparison temperature.

12. The method according to claim 11, wherein the first comparison temperature is the same as the fourth comparison temperature and the second comparison temperature is the same as the third comparison temperature.

13. An image forming apparatus, comprising:

an image forming unit configured to form an image on a sheet; and a control unit configured to determine a first temperature in the image forming apparatus at a location other than the image forming unit of the image forming apparatus;

determine a second temperature in the image forming unit;

operate the image forming unit continuously according to a printing instruction when the first temperature is below a first comparison temperature and the second temperature is below a second comparison temperature;

operate the image forming unit intermittently according to the printing instruction when the first temperature is equal to or higher than the first comparison temperature and the second temperature is equal to or higher than the second comparison temperature, wherein operation of the image forming unit intermittently comprises stopping operation of the image forming unit between repeated image forming by the image forming unit according to the printing instruction; and determine a stop control number that corresponds to a number of stops of the image forming unit while operating intermittently.

14. The image forming apparatus according to claim 13, wherein the control unit is further configured to operate the image forming unit in a first intermittent mode having a first stop time when the stop control number is less than a threshold stop control number; and operate the image forming unit in a second intermittent mode having a second stop time when the stop control number is greater than or equal to the threshold stop control number, wherein the second stop time is longer than the first stop time.

15. The image forming apparatus according to claim 13, wherein the control unit is further configured to increase the stop control number by one after each stop of the image forming unit while operating intermittently;

determine if a number of printings equals a predetermined number of printings;

when the number of printings equals the predetermined number of printings, increase the predetermined number of printings by the number of printings; and when the number of printings does not equal the predetermined number of printings, determine if all printing according to the printing instruction is completed.

16. The image forming apparatus according to claim 15, wherein the control unit is further configured to when all printing according to the printing instruction is not completed, increase the number of printings by one; and when all printing according to the printing instruction is completed, initialize the number of printings.

17. The image forming apparatus according to claim 13, wherein the control unit is further configured to initialize the stop control number when the second temperature is less than or equal to a third comparison temperature.

18. The image forming apparatus according to claim 17, wherein the control unit is further configured to initialize the stop control number when the second temperature is greater than the third comparison temperature and the first temperature is less than a fourth comparison temperature.

* * * * *